US011191323B2

(12) United States Patent
Davidson

(10) Patent No.: US 11,191,323 B2
(45) Date of Patent: Dec. 7, 2021

(54) SHAPER FOR FLEXIBLE OBJECTS

(71) Applicant: Voguish Fill, Severna Park, MD (US)

(72) Inventor: Madeline Cary Davidson, Annapolis, MD (US)

( * ) Notice: Subject to any disclaimer, the term of this patent is extended or adjusted under 35 U.S.C. 154(b) by 97 days.

(21) Appl. No.: 16/516,562

(22) Filed: Jul. 19, 2019

(65) Prior Publication Data

US 2021/0015213 A1 Jan. 21, 2021

(51) Int. Cl.
*A43D 3/14* (2006.01)

(52) U.S. Cl.
CPC ..... *A43D 3/1416* (2013.01); *A43D 3/1491* (2013.01)

(58) Field of Classification Search
CPC ..... A43D 3/1416; A43D 3/1491; A43D 3/14; A43D 3/1433
See application file for complete search history.

(56) References Cited

U.S. PATENT DOCUMENTS 4,497,080 A * 2/1985 Inspector ..... A43D 3/1416 12/128 R
6,378,224 B1 * 4/2002 Qualkinbush ..... A43B 3/0026 34/104
7,930,837 B1 * 4/2011 Huebner ..... A43D 3/1491 34/95
8,539,692 B1 * 9/2013 Huebner ..... A43D 3/1475 34/95
8,881,960 B1 * 11/2014 Gironella ..... A43D 3/1416 223/84
2009/0031507 A1 * 2/2009 McChesney ..... A43D 3/1433 12/115.6
2017/0079381 A1 * 3/2017 Jordan ..... A43D 3/1433
2017/0332738 A1 * 11/2017 Ouimet ..... A43D 3/1416

* cited by examiner

*Primary Examiner* — Ted Kavanaugh

(74) *Attorney, Agent, or Firm* — Laubscher & Laubscher, P.C.

(57) ABSTRACT

A shaper for a pliable object includes a flexible sleeve formed of a semipermeable material and containing a chamber in which a fibrous fill material and a semi-rigid member are arranged. The fibrous fill provides shape and structure to the flexible sleeve to generally match the configuration of an object into which the shaper will be placed. The semi-rigid member has a length-to-width ratio that is substantially similar to the length-toi-width ratio of the flexible sleeve. When the sleeve is arranged within an object, it substantially fills the object to provide the object with structure and shape retention.

9 Claims, 2 Drawing Sheets

SHAPER FOR FLEXIBLE OBJECTS

BACKGROUND OF THE DISCLOSURE

The present disclosure relates to a shaper for flexible objects, and more particularly to a fabric-based shaper having a structure for retaining the shape of an object.

Fashionable items such as shoes, boots and purses are often made of flexible material, which allows the items to adapt their shape based on need. With a more rigid material, a pair of boots for instance, would not provide the comfort and flexibility a user prefers and often needs. The flexible material has its drawbacks, however. When items, such as a boot, are not in use, the nature of the flexible material causes the boot to lose its structure and fold down upon itself. This causes wear and can create permanent wrinkles that are unsightly.

To solve this problem, shapers have been created that can be inserted into shoes, bags and other such items to help an item remain in its upright, expanded position, as if they were being used. Known shapers are typically made of cardboard, plastic or other rigid or semi-rigid material. The shapers are configured so as to match the inner opening of shoes, bags and other items. Some are hollow with open ends, while others are closed off at both ends. The shapers are often found in shoes, boots and bags on display in stores, and are typically meant to be discarded once the item is sold. Some are reused with other displayed items or are manufactured for use throughout the life of an item.

One problem with these conventional shapers is that they typically need to be manufactured to fit a specific shoe or bag and/or they are manufactured for short-term use. Some shapers are adjustable and built for long-term use, but they can be cumbersome to use and are typically not fashionable. Further, beyond shaping the item in which they are placed, known shapers do not offer benefits beyond providing shape retention.

SUMMARY OF THE DISCLOSURE

Accordingly, it is an object of the present disclosure to provide a fashionable shaper for pliable objects which is simple to use and simple to store when not in use, and which provides a pleasant fragrance. The shaper includes a flexible sleeve which is formed of a semipermeable material and which contains a chamber. Arranged within the chamber is a fibrous fill material that provides shape and structure to the flexible sleeve. In addition, a semi-rigid member is arranged within a central portion of the chamber to further the stability and structure of the shaper. The semi-rigid member has a length-width ratio that is substantially similar to the length-width ratio of the flexible sleeve. When the sleeve is arranged within an object, it substantially fills the object to provide the object with structure, retaining its shape. In a preferred embodiment, the flexible sleeve has an elongated configuration and the semi-rigid member is a dowel.

In another embodiment, the semi-rigid member is arranged in an enclosed bag filled with sand and a pouch including stones and an essential oil pad are arranged in a lower portion of the chamber. The enclosed bag with sand and stones provide further structure and support to the shaper, and the essential oil pad provides a therapeutic and pleasant fragrance.

BRIEF DESCRIPTION OF THE FIGURES

Other objects and advantages of the disclosure will become apparent from a study of the following specification when viewed in the light of the accompanying drawing, in which.

DETAILED DESCRIPTION

The present disclosure involves a fashionable shaper for retaining the shape of a pliable object. The shaper can be used for a number of devices, but preferably is used for boots, shoes, or bags, all of which are typically made of a flexible material such as leather.

Figure 1:
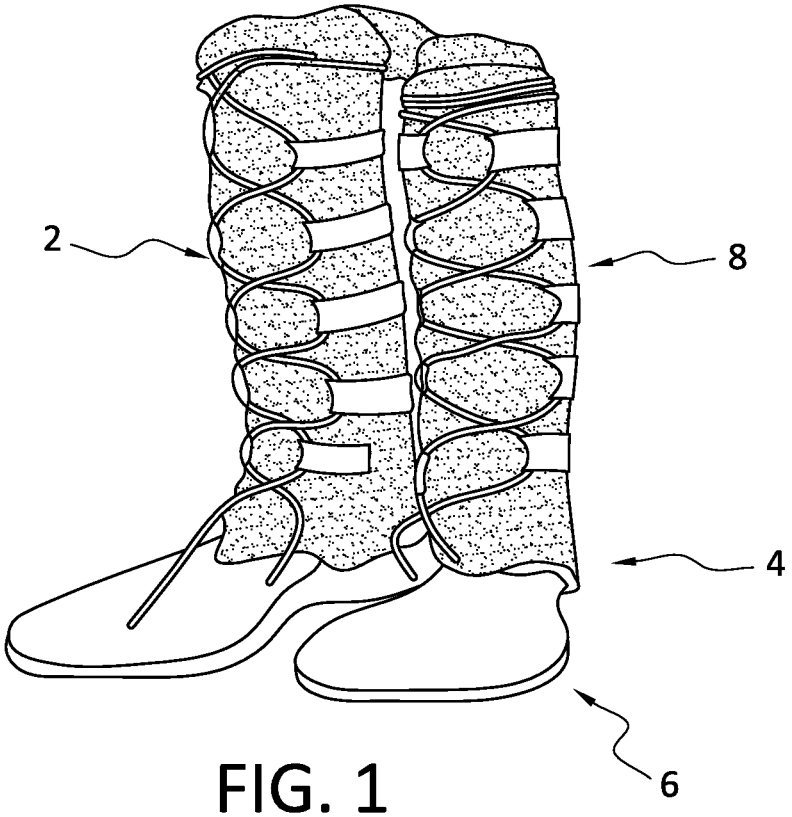
FIG. 1 is a perspective view of a first embodiment of the shaper according to the present disclosure.

FIG. 1 shows a first embodiment of a shaper 2 according to the present disclosure. The shaper is inserted into a pair of sandals 4 having a lower foot portion 6 and an upper leg portion 8. The shaper 2 is inserted into the leg portion 8 of each sandal to keep the leg portion in an upright, expanded position, as it would be when the sandals are being worn by a user. Without the shaper, the leg portion 8 would fold down upon itself and lose its form, causing it to prematurely wear and wrinkle. Although FIG. 1 illustrates a sandal for receiving the shaper, the shaper could be used with other items that similarly require their shape to be retained to reduce wear. For example, the shaper may be used with leather boots or shoes, a leather handbag or tote, or other such items that sit upright, are made of flexible material, and have an inner chamber accessible via an opening.

Figure 2:
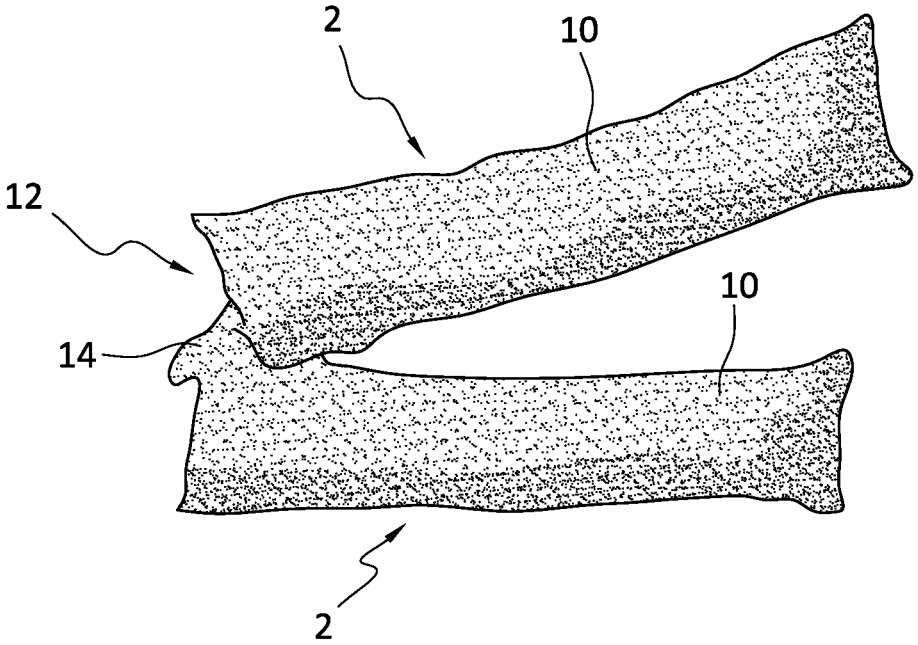
FIG. 2 is a top view of the embodiment shown in FIG. 1.

FIG. 2 shows the two shapers 2 of FIG. 1 removed from the sandals. The shapers have a flexible, semipermeable floral fabric sleeve 10 and an elongated configuration which generally matches the configuration of the leg portion 8 of the sandals in FIG. 1. The shaper is filled with a fibrous material (not shown) which provides shape and structure to the shaper. The shapers in FIGS. 1 and 2 have a generally cylindrical configuration. As noted above, the shaper could have other configurations for use with other objects, such as with a leather bag that has a generally cubical configuration. To provide proper shape retention, the configuration is preferably similar to the dimensions of the object with which it is used.

Figure 3:
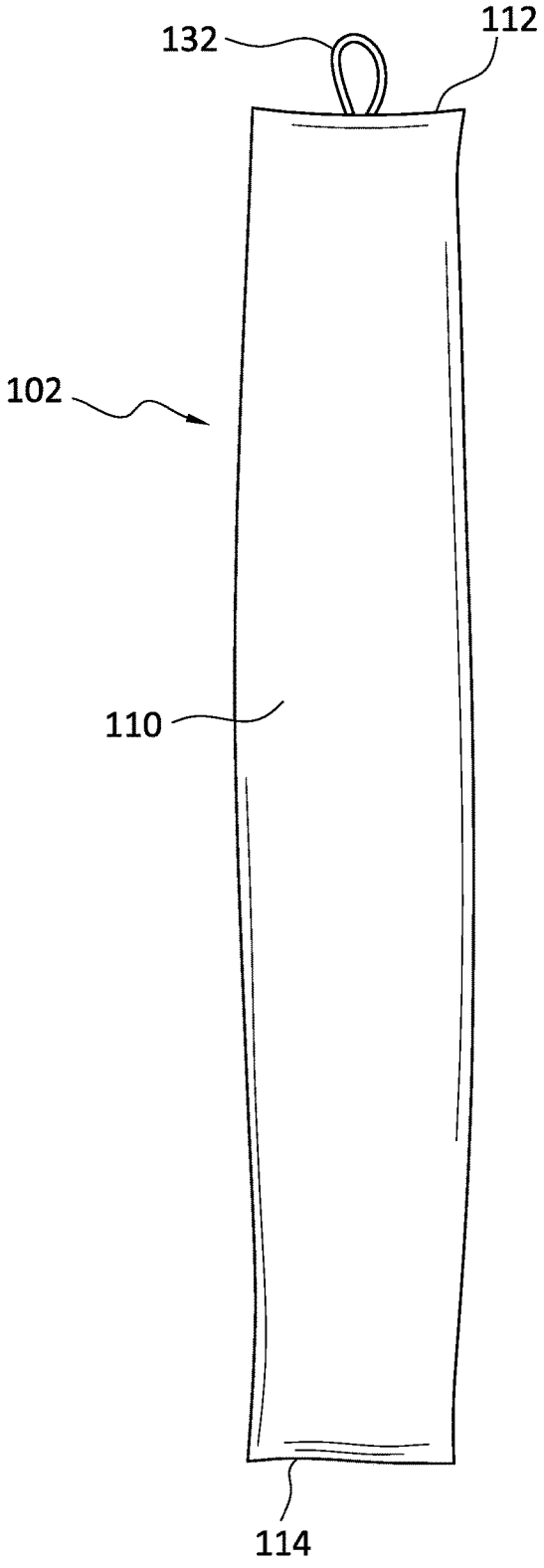
FIG. 3 is a front view of a second embodiment of the shaper according to the present disclosure.
Figure 4:
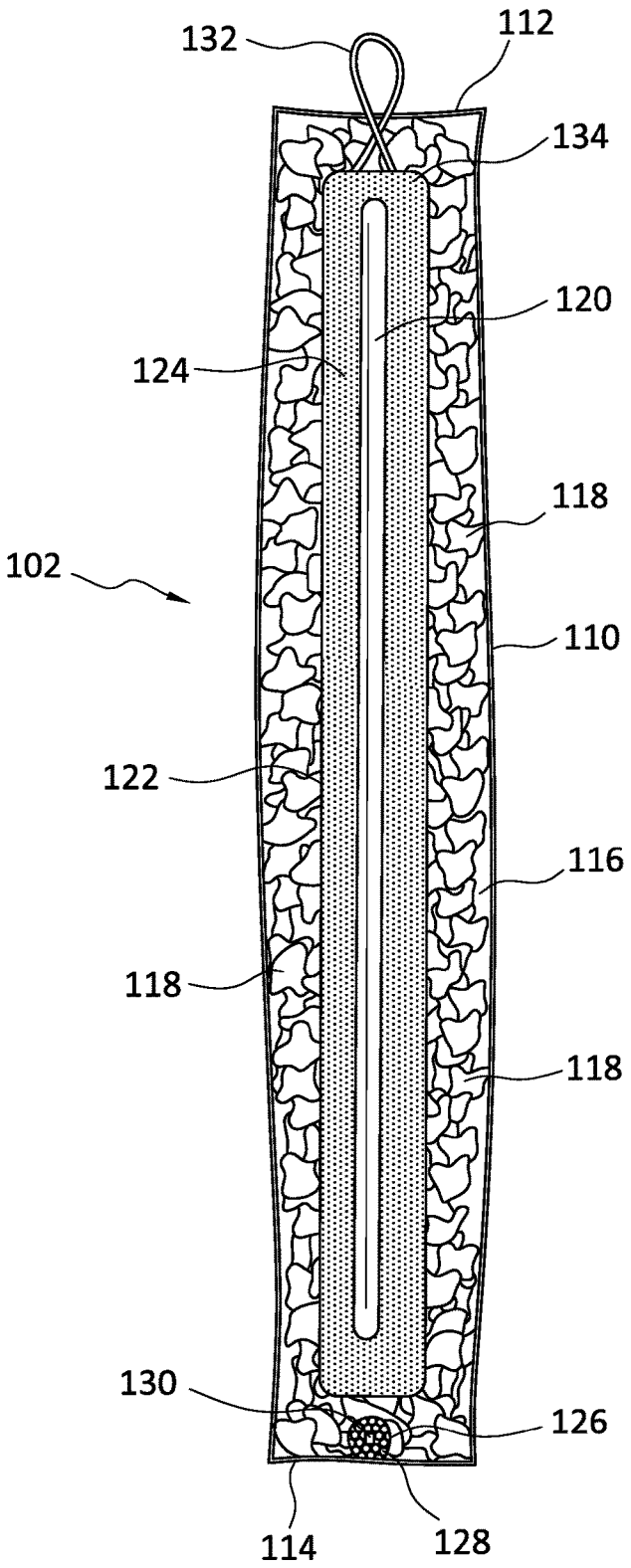
FIGS. 4 is a front cross-sectional view of the embodiment of FIG. 3.

FIGS. 3 and 4 show a second embodiment of a shaper 102 according to the present disclosure. The shaper includes a flexible sleeve 110 having an upper end 112 and lower end 114. The sleeve is formed of a semipermeable material and includes an inner chamber 116 filled with a fibrous material 118, such as polyester, cotton or other similar materials. The fibrous material provides shape and structure to the flexible sleeve. Additional structure is provided by a semi-rigid dowel 120 inserted into a central portion of the chamber. When the shaper is inserted into a flexible object, for instance a boot, the sleeve provides an outwardly directed force due to the fibrous fill 120, and the dowel 120 assists in keeping the flexible object in its upright position. Without the fibrous fill and dowel, the flexible object would not remain in an upright expanded position.

Notably, the dowel 120 has a length-to-width ratio that is substantially similar to the length-to-width ratio of the flexible sleeve. The dowel is encased by an enclosed bag 122 filled with sand 124, and the chamber further includes a pouch 126 having stones 128 and an essential oil infused pad 130 arranged therein. The enclosed bag with sand adds further structure and weight to the shaper, and the pouch provides further stability by increasing the weight of the shaper at its lower end. Though the pouch in FIG. 4 contains stones, it will be understood by those with skill in the art that any similarly weighted object and/or objects, for instance metal weights, could be included in the pouch, or simply arranged within a bottom portion of the chamber 116.

In addition to the pad 130, providing essential oils is an important aspect of the embodiment of FIGS. 3 and 4. Beyond the advantageous structural elements of the shaper, the essential oils provide a pleasant and therapeutic fragrance to the object into which the shaper is placed, as well as reduce the effect of any odor that the object might have. Though the essential oils are provided via a pad 130 that is retained within the pouch 126, it will be understood by those with skill in the art that the pad could be located in a different portion of the chamber. Further, rather than a pad, the essential oils could be provided with a different device altogether.

Referring again to the embodiment of FIG. 4, there is a handle 132 connected with an upper end 134 of the enclosed bag 136 for removing the encased dowel 120 when the shaper is not in use. In that embodiment the chamber 116 of the flexible sleeve 110 can be accessed to add or remove the fibrous fill 118, the weighted pouch 126 and/or the encased dowel. This allows the shaper to be used with more than one object by adjusting its fill and structure. In a separate embodiment, the top end of the sleeve 112 is closed and the handle extends therefrom.

Although the above description is with reference to particular embodiments, it is to be understood that these embodiments are merely illustrative of the principles and applications of the present disclosure. It is therefore to be understood that numerous modifications may be made to the illustrative embodiments and that other arrangements may be devised and employed without departing from the spirit and scope of the present disclosure.

What is claimed is:

1. A shaper for a flexible object, comprising:

a. a flexible sleeve containing a chamber, said sleeve being formed of a semipermeable material b. a fibrous fill material arranged in said chamber for providing shape and structure to said flexible sleeve; and c. an enclosed bag including a semi-rigid member and a granular material arranged in said chamber, said semi-rigid member having a length-width ratio substantially similar to a length-width ratio of said sleeve, whereby when said sleeve is arranged within a flexible object, said sleeve substantially fills the flexible object to provide it with structure to retain its shape.

2. An object shaper as defined in claim 1, and further comprising a pouch containing an inner chamber with one of stones and metal retained therein, said pouch arranged in a lower portion of said flexible sleeve.

3. An object shaper as defined in claim 2, and further comprising at least one essential oil diffuser within said flexible sleeve chamber.

4. An object shaper as defined in claim 3, wherein said essential oil diffuser is retained within said pouch.

5. An object shaper as defined in claim 4, wherein said essential oil diffuser comprises a pad.

6. An object shaper as defined in claim 1, wherein said flexible sleeve comprises an elongated configuration.

7. An object shaper as defined in claim 6, wherein said semi-rigid member comprises a dowel.

8. An object shaper as defined in claim 1, wherein said flexible sleeve includes a closed upper end.

9. An object shaper as defined in claim 1, and further comprising a handle extending from an upper end of one of said flexible sleeve and enclosed bag.

* * * * *